United States Patent [19]

Donakowski et al.

[11] 4,126,483

[45] Nov. 21, 1978

[54] METHOD OF ADHERENCY OF ELECTRODEPOSITS ON LIGHT WEIGHT METALS

[75] Inventors: William A. Donakowski, Dearborn Heights; John R. Morgan, Southfield, both of Mich.

[73] Assignee: Ford Motor Company, Dearborn, Mich.

[21] Appl. No.: 843,756

[22] Filed: Oct. 19, 1977

Related U.S. Application Data

[62] Division of Ser. No. 803,200, Jun. 3, 1977.

[51] Int. Cl.[2] ..... C23G 1/12; C23G 1/22

[52] U.S. Cl. ..... 134/3; 134/28; 134/29; 134/30; 204/33; 156/665

[58] Field of Search ..... 204/33; 427/327, 328; 156/665; 134/42, 28, 29, 3, 30

[56] References Cited

U.S. PATENT DOCUMENTS

| | | | |
|---|---|---|---|
| 2,067,703 | 1/1937 | Robinson et al. | 204/33 X |
| 2,586,099 | 2/1952 | Schultz | 204/33 X |
| 2,828,193 | 3/1958 | Newman | 156/665 X |
| 2,871,171 | 1/1959 | Atkinson | 204/33 |
| 2,939,772 | 6/1960 | Newman | 134/42 X |
| 3,031,387 | 4/1962 | Deal et al. | 204/33 X |
| 3,374,155 | 3/1968 | Weber | 204/33 X |
| 3,834,998 | 9/1974 | Watanabe et al. | 204/33 |

*Primary Examiner*—John H. Mack
*Assistant Examiner*—William Leader
*Attorney, Agent, or Firm*—Joseph W. Malleck; Olin B. Johnson

[57] ABSTRACT

A method of treating an aluminum article prior to plating by first cleaning the article to be substantially free of aluminum oxide and then immersing the article in a solution containing sodium hydroxide, sodium metasilicate, trisodium phosphate and sodium carbonate.

2 Claims, 17 Drawing Figures

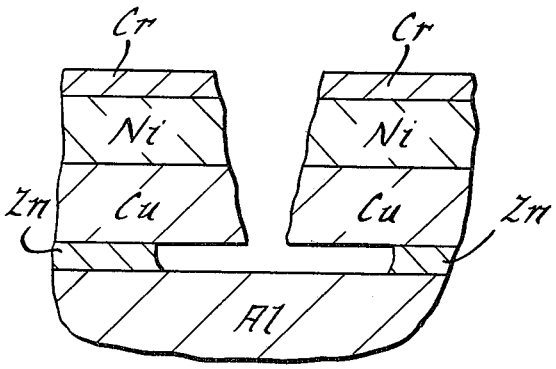
FIG. 3.
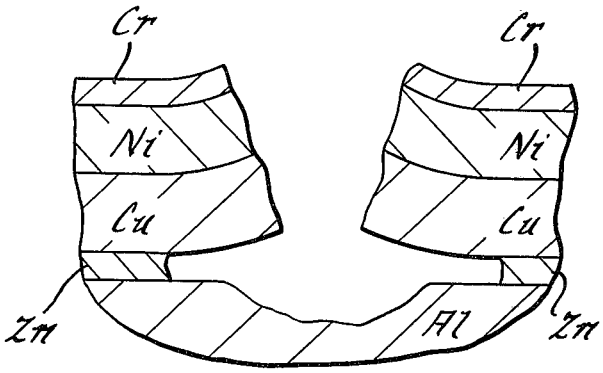
FIG. 4.
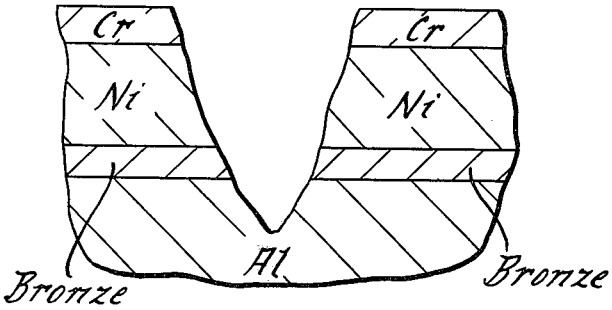
FIG. 5.
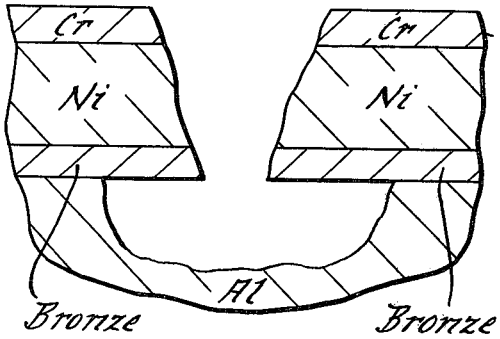
FIG. 6.
FIG. 7.
FIG. 8.
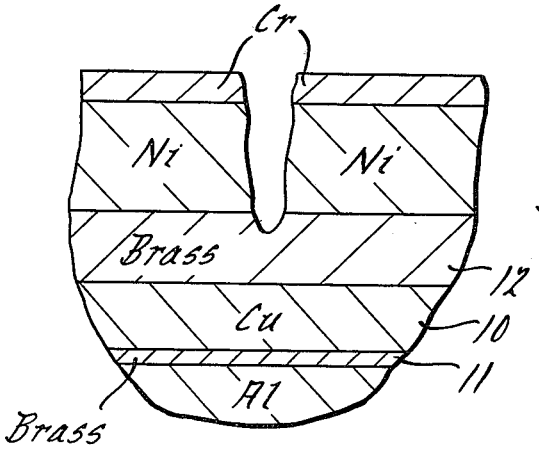
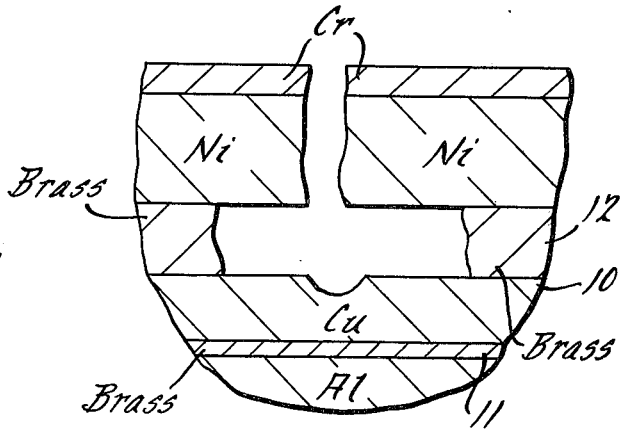

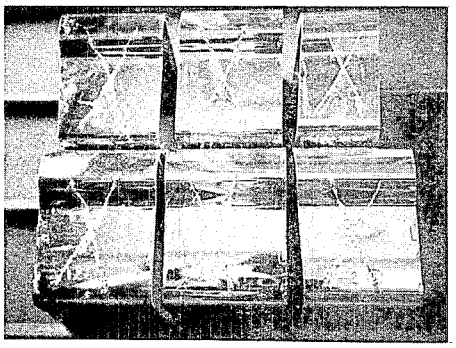
FIG. 9.
FIG. 10.
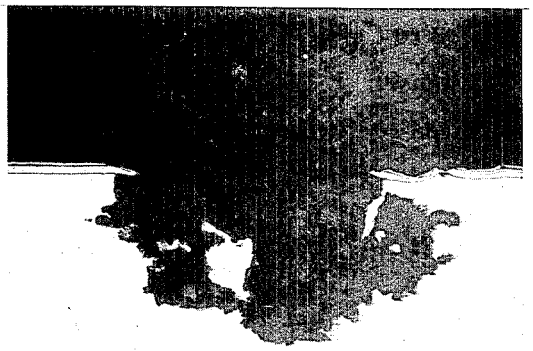
50X
63% Cu
FIG. 11.
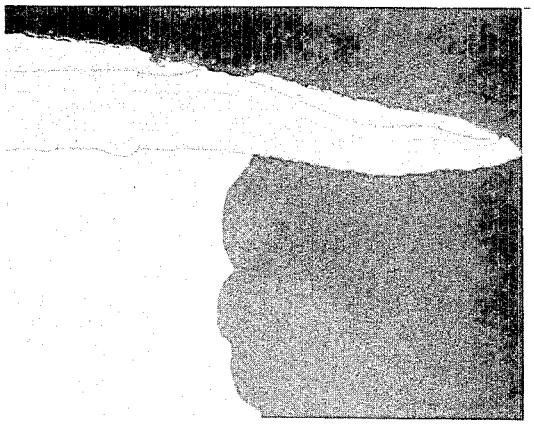
500X
63% Cu

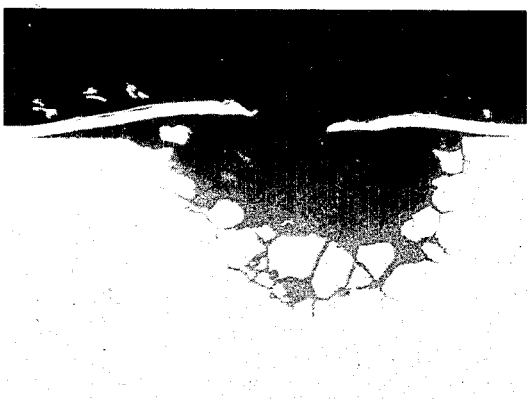
50X
56% Cu
FIG. 12.
FIG. 13.
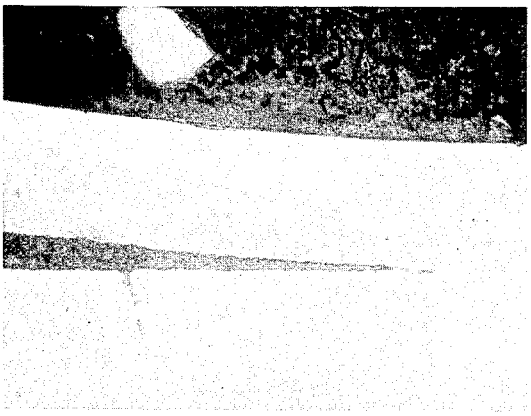
500X
56% Cu
FIG. 14.
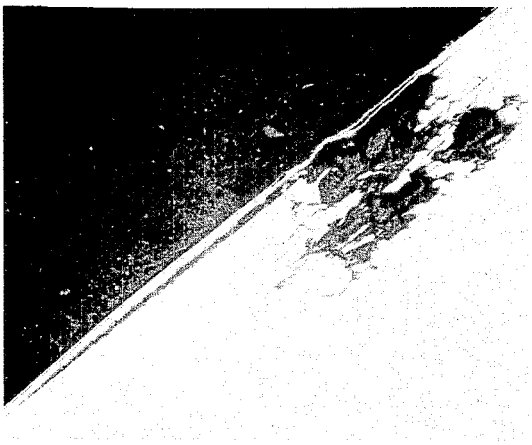
50X
42% Cu

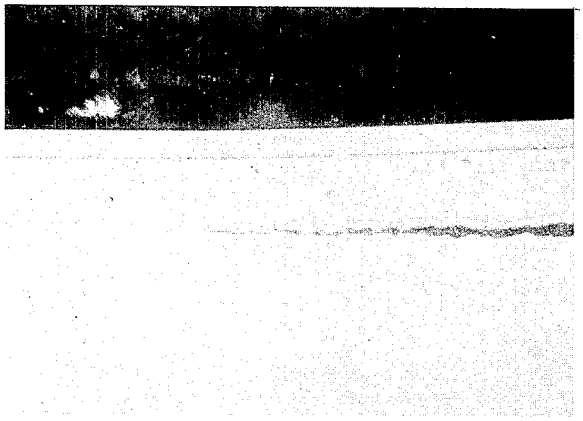
500X
42% Cu
FIG. 15.
FIG. 16.
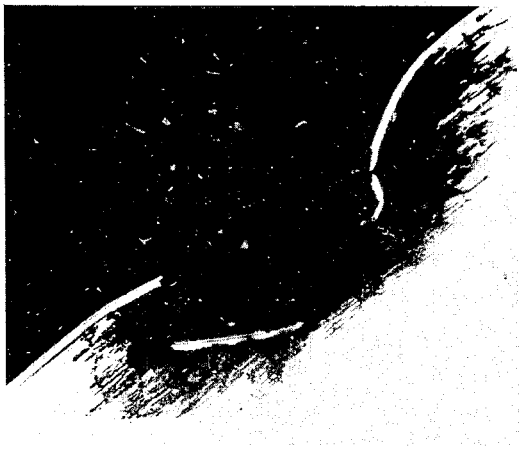
50X
26% Cu
FIG. 17.
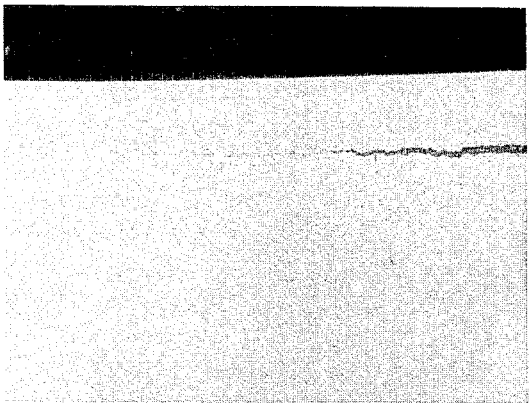
500X
26% Cu

METHOD OF ADHERENCY OF ELECTRODEPOSITS ON LIGHT WEIGHT METALS

This is a division of application Ser. No. 803,200, filed June 3, 1977.

BACKGROUND OF THE INVENTION

Considerable attention is being devoted to weight reduction in automotive design in order to conserve energy. In the case of automobile bumpers, it is necessary to reduce weight and meet governmental bumper impact standards without sacrificing durability, appearance, cost-effectiveness and styling versatility of nickel-chromium plating.

High strength aluminum alloys present one promising avenue to reducing the weight of bumper systems and at the same time meet the governmental bumper impact standards. However, is it not possible, prior to this invention, (1) to commercially electroplate a consistently adherent metal coating directly on aluminum, particularly a brass coating, and (2) to provide a bright lustrous coating system for an aluminum substrate which experiences minimal lateral corrosion. This is due to several problems among which include the natural oxide film that is present upon aluminum and the interference caused by such oxide film in achieving a sound adherency between any plated material over the aluminum base. If the natural oxide film is somehow removed and replaced by a plated system, the natural corrosion resistance of aluminum is sacrificed and the plated materials become a potential galvanic couple in a corrsoive environment. In such a couple, aluminum will become the anode and will tend to dissolve. Since aluminum is more reactive than steel, the dissolving rate can actually be faster than with steel bumpers.

The performance of plated aluminum can be influenced by the pre-plating treatment or underlayment system, both referred to hereinafter as pretreatment. Over the years, a number of pretreatments have been proposed, most directed to the problem of achieving high adherency. Only a few have been successful and these only to a small degree. They include (a) a chromium on nickel on copper on zinc on aluminum system (typically referred to as the zincate process), (b) a chromium on nickel on bronze on tin or aluminum system (typically referred to as the Alstan process), (c) a chromium on brass (high zinc content) on aluminum system (referred to as the Dupont process), a chromium on nickel on an immersion zinc layer (which is dissolved to some degree during immersion in the nickel bath) on aluminum system (referred to as the Alcoa 661 process), and (d) a phosphoric acid anodizing treatment wherein a chromium on nickel on anodic oxide on aluminum system is employed. Each of these systems are deficient either because they do not achieve proper adherency or they create excessive galvanic couples which accelerate corrosion between the various elements of the system.

Most of the prior art top-coat systems of decorative use here, such as nickel and chromium, were developed for use on mild steel substrates and have found particular utility therein; the top-coat systems were subsequently transplanted for use with aluminum in the hope that their performance would be comparable. However, it must be recognized that different physical parameters do exist when a plating system is applied to aluminum. An electromotive force may exist between any of the elements of these plating systems when tied to aluminum that may not exist when tied to steel. The natural oxide coating on aluminum inhibits a tight adherency of the plated system. Without proper adherence, the nature of the galvanic couple therebetween may be increased or decreased due to the change in the current flow between the electrolyte of the galvanic couple and the particular metal forming the poles of the couple. For example, although stainless steel is much more noble than say copper, its effectiveness in the galvanic couple is considerably greater because of its high resistance to current flow through its interface with the electrolyte. Thus, plating systems for steel substrates must be carefully analyzed because of the unpredictable nature of applying such systems to aluminum and still achieve comparable results with respect to adherency and corrosion resistance.

In a separate path of technology and in an effort to cut down on the degree of electromotive potential between the elements of the system thereby hoping to improve lateral corrosion resistance, brass has been introduced in two known instances by the prior art for use in plating steel. In the first instance, the brass was constituted to contain a high proportion of zinc, about 70%, with copper maintained at about 30%. If this use of brass were to be applied to an aluminum substrate, zinc, being a highly reactive metal would become sacrificial and corrosion would proceed very rapidly laterally in the brass layer producing peeling and blistering under the decorative coating. In addition, the system would be limited to undesirable immersion coating techniques since consistent adherency of such a brass on aluminum by electroplating is not possible by the state of the art.

In the second instance, it was conceptualized that the electromotive potential of brass should be increased so that it is between steel and nickel; any galvanic couple created would be less and thereby slow down the rate of corrosion. This was implemented by increasing the copper content of the brass to 45–60%. If this concept were to be applied to an aluminum substrate, adherency of electroplating would still remain a severe problem and the galvanic couple between the increased-copper-brass and the aluminum would be greater than on steel; the brass would not be able to provide preferential cathodic protection to the decorative outer layers.

Accordingly, what is needed is a pretreatment which (1) provides for consistently good adherency of electroplated elements on aluminum, (2) reduces the galvanic couple potential between the aluminum and the most adjacent layer.

SUMMARY OF THE INVENTION

A primary object of this invention is to provide an economical and easily controllable coating system for highstrength aluminum alloys, said coating system providing a lustrous decorative finish, a high degree of adherency of the plating system to the aluminum, and provides for increased lateral corrosion resistance.

Another object of this invention is to provide a pretreatment for a lustrous coating system to be used upon aluminum substrates, which will be exposed in a highly corrosive environment, such as that of bumpers on an automobile, the pretreatment system eliminating large voltage couples which accelerate corrosion between elements of the plating system and/or with the aluminum or lustrous finish.

Still another object of this invention is to provide a method of plating and to produce a plated system for highstrength aluminum alloys which provides unprecedented adhesion with the aluminum substrate without the necessity for complicated cleansing or pretreatment steps.

Yet still another object of this invention is to provide a plating system for aluminum which insures a high lustrous decorative finish with a reduced quantity of plating materials.

Still another object is to provide a method of pretreating aluminum bumpers with a minimum capital investment and by utilizing present facilities normally employed for plating steel.

Features ursuant to the above objects comprise: (a) the use of an aluminum alloy substrate containing 1–8% zinc, the zinc intermetallic compounds in the substrate forming, during processing, a tight intermolecular bond with selected materials of a pretreatment system, which particularly must include brass as an initial strike having a copper content of 20–75%, (b) eliminating lateral corrosion within the plated system by employing either one or all of (i) recrystallized aluminum alloy, (ii) an aluminum substrate containing 4.0–5.5 zinc, (iii) constituting the metal strike in contact with the substrate to have 60–75% copper and the remainder zinc, (c) constituting a brass pretreatment plating solution of cyanide compounds and having a high content of copper, the solution having ingredients proportioned to provide for better throwing power and tightness of the plated material, such as maintaining the ratio of sodium cyanide to metal in the range of 1.2–1.6 times the metal and avoiding an arsenic impurity above 0.0001% by weight, (d) insuring a controlled type of corrosion, which is substantially confined to micro-pits oriented vertical to the plated surface or controlling the corrosion to permit a slow rate of lateral corrosion in an intermediate layer by enveloping a copper pretreatment layer in two layers of brass, the brass layer must adjacent the aluminum containing 60–75% copper and the layer most adjacent the decorative plating system comprising 50–60% copper by weight, (e) the maintenance of a bright lustrous decorative finish by employing lustrous copper or copper and nickel as an undercoating for nickel and chromium overlayers, while at about the same time promoting corrosion protection by enveloping such copper or copper and nickel layer with brass containing a high content of copper, and (f) restricting cleaning and plating techniques to that which are interchangeable for plating steel.

SUMMARY OF THE DRAWINGS

FIGS. 3 and 4 are schematic diagrams of the sequence of corrosion as it proceeds through a coating system of the prior art commonly referred to as the zincate treatment.

FIGS. 5 and 6 illustrate graphically the progress of corrosion for another prior art coating system commonly referred to as the Alstan process;

FIGS. 7 and 8 illustrate the progress of corrosion for a coating system in conformity with the present invention;

FIG. 9 is a photograph of samples exposed to the CASS test, said samples having varying as-deposited copper contents in the brass strike applied to a 7029 aluminum alloy.

FIGS. 10 through 17 respectively represent photomicrographs of samples prepared according to the invention and those outside the invention, showing the presence or absence of blisters and other types of corrosion defects.

DETAILED DESCRIPTION

Figures 1, 2:
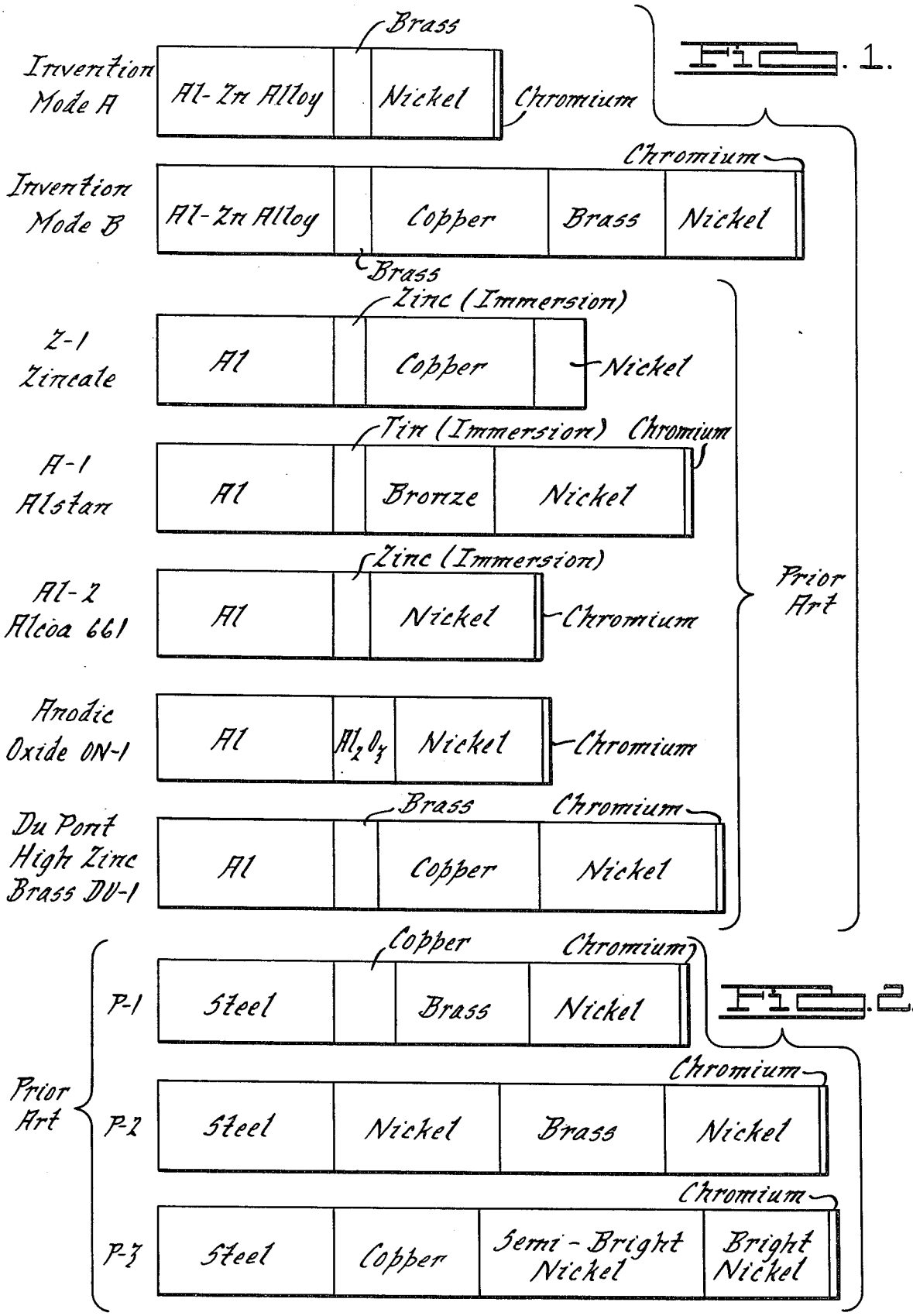
FIG. 1 is a graphical illustration of various prior art coating systems on aluminum and the coating system of the present invention.
FIG. 2 is a graphical illustration similar to that of FIG. 1, for prior art coating systems employed on steel or iron.

The invention is concerned with employing aluminum or magnesium as a light weight substrate upon which is plated a bright lustrous decorative metallic finish, typically comprised of nickel and chromium. Both aluminum and magnesium present, to varying degrees, the same problem of adherency of a plated system thereon due to their inherent protective qualities. Similarly, both present somewhat the same problem will respect to galvanic corrosion since they are comparable in the electromotive series and would present similar galvanic couples with respect to the various types of plating systems that have been employed by the prior art. Hereafter, when reference is made to aluminum, magnesium shall also be considered as included unless noted. Given aluminum as the substrate, the desire for a bright lustrous decorative outer plating system, and the need for a low cost approach to the coating system, the process must provide excellent adherency and low lateral corrosion qualities.

ADHERENCY

Direct current electroplating of metals directly onto aluminum has not become commercially successful and only direct plating of chromium has become feasible. Instead, most electroplating on aluminum is commercial practice is carried out by use of an intermediate chemical immersion layer of zinc, commonly applied by the zincate process, or by use of other immersion layers of bronze or tin. Selected immersion layers such as zinc, brass, Zn-Ni, and tin chemically displace the oxide film on aluminum which then provides a base for adhering a plating of other metals. Unfortunately, the immersion methods are more an art than a science because the actual mechanism for adhesion is not well understood and undesirable variances appear. Other metals won't even adhere by the immersion method, such as nickel, copper and iron.

The difficulty of plating on aluminum was examined extensively by Schwartz and Newkirk at the University of Colorado in 1972 and they concluded that DC plating on aluminum with the most desirable plating metals, such as brass or copper-lead, was not feasible. Svendalah of DuPont in 1974 also investigated DC plating of brass onto aluminum and concluded that the electroltye must be adjusted to constitute the plate almost entirely of zinc before good adhesion is obtained, assuming some mode of dissolving the oxide film has occurred. Thus, the DuPont approach almost duplicates a zinc immersion method. This is further undesirable because the plated hi-zinc brass is readily attacked and dissolved in subsequent acid dips or plates necessary to plating nickel if not protected by additional barrier elements.

This invention has found that good adhesion can be realiably obtained by DC plating of brass directly onto aluminum provided the aluminum substrate is selected to contain 1–8% alloyed zinc and the brass electrolyte is constituted not only to deposit out brass having considerable copper 26–75%, but also to contain adequate caustic elements which dissolve the oxide film and some of the aluminum. It is believed that upon entering the brass electrolyte with the current on, some alloyed zinc in surface regions of the aluminum article is redistributed to form a zinc-rich intermediate region in the plating promoting adherency of the brass. The phenomena appears to draw zinc only from the substrate to promote a more compatible crystal sutructure uniting the substrate and plate. An absence of alloyed zinc in the article along with some or increasing zinc in the brass electrolyte did not provide for improved adherency. In addition, the high copper brass is not attacked by subsequent acid or plates necessary to plating nickel and thus no intermediate barriers need be used.

A preferred method of carrying out this invention is as follows:

1. Provide a wrought or extruded aluminum article or substrate having 1–8% alloyed zinc; lessor amounts of alloyed zinc affects adhesion and greater amounts of zinc undesirably affect the physical characteristics of the aluminum.

2. Subject the aluminum article to the following cleaning anc activating cycle which removes foreign matter and oxide films from the article:

(a) soak in a mild alkaline cleaning solution for 1–4 minutes at 140°–180° F, and power spray with a similar alkaline solution at 110°–130° F followed by rinsing in water at room temperature;

(b) etch the article in another alkaline water solution preferably formed by adding a powdered additive consisting of 68% sodium hydroxide, 0.5% min. trisodium phosphate, 15% sodium metaphosphate, and 10% max. sodium carbonate;

(c) de-smut the article in a sulfuric acid solution (2–12% by volume) with added fluoride salts, such as 0.25 oz./gal. ammonium bifluoride, and/or hydrogen peroxide; water rinsing at room temperature is applied to the article after each of the soak, etch and de-smut steps.

3. Immediately subject the cleaned and etched article to a DC plating cell with the article arranged as the cathode, to plate on said article a thin brass strike (0.00005–0.0001 inch) which contains 26–75% by weight copper as deposited. the electrolyte is a cyanide solution and carries the full plating voltage at the instant the article enters; plating should be carried out for 3–10 minutes at preferably 30–50 (or operably 20–60) amps./ft$^2$ as the average current density. The electrolyte should preferably contain:

2–5 oz./gal. sodium hydroxide
4–12 oz./gal. sodium carbonate
3.6–9.6 oz./gal. free sodium cyanide
3–6.0 oz./gal. metal elements divided between copper and zinc in the proportion of 68–85 copper and 15–32% zinc, the ratio between the sodium cyanide and metal being 1.2–1.6 times the metal.

Several tests examples will bear out the importance of the alloyed zinc in the aluminum substrate and the copper content of the brass for achieving adhesion. The sample preparation consisted of selecting various lots of aluminum alloy panels (about 4" × 4"), including heat-treatable and non-heat treatable alloys, and;

(a) buffing one side of each panel (in the case of clad materials, the bottom half was buffed only);

(b) applying acetone to remove buffing compound;

(c) soaking and brushing clean each panel in a solution at 160° F prepared with 8 oz./gal. of a powdered additive consisting by weight of 2.5–3.5% sodium metasilicate, 17.5–18.5% sodium pyrophosphate, 31.0–32% sodium tetraborate 0.5–1.5% surfactants and wetters, and 23–24% complex organics;

(d) rinse;

(e) soak in a solution at 160° F for ½ minute, the solution being prepared by use of 8 oz./gal. of a powdered additive consisting of 68% sodium hydroxide, 15–20% sodium metasilicate, 0.5% min. trisodium phosphate, 10% max. sodium carbonate, balance sodium hydroxide, and 3.5% max. moisture;

(f) rinse;

(g) soak again in a solution as in (e) at 160° F for ½ minute;

(h) rinse;

(i) dip in a water solution of 50% $HNO_3$ for 15 seconds;

(j) rinse;

(k) placing in electrolyte of brass plating cell with current on, using the panel as a cathode; average current density is about 35 ASF and the electrolyte consisting of (all in oz./gal.) 5.8 free NaCN, 2.4 NaOH, 8.0 $Na_2CO_3$, 2.9 Cu, 1.5 Zn. Plating is carried out for 4 minutes. The as-deposited copper content of the brass was about 57%. For certain samples, as noted, the brass copper content was varied;

(l) rinsing (if adherent, the plating is carried out for another 9 minutes; visual check only);

(m) placing each panel in an acid copper plating cell with current on for 5 minutes to plate a copper strike thereover;

(n) rinsing;

(o) determine adhesion qualitatively by

1 - rapping with coarse file,
2 - sawing
3 - bending panel by folding back upon itself (180° bend).

The results of the tests, as shown in Table I, clearly show that with aluminum substrates containing 1–8% zinc (see Table II), adhesion became excellent, regardless of the other alloying elements.

TABLE I

| Panel Alloy | Visual Inspection of Adhesion after Brass Strike | Check of Adhesion after Copper Plate by 3 Tests |
|---|---|---|
| 2024 | Looked OK | Blisters and peeling |
| 2036 | No adhesion | No adhesion |
| 3003 | No adhesion | No adhesion |
| 3105 | Blistered and peeled to Al. | Blisters and peeling |
| 4343 | Blistered and peeled to Al. | Blisters and peeling |
| 5457 | Peeled to Al. | Peeling |
| 5557 | Peeled to Al. | Peeling |
| 6061 | Very heavy blistering | Poor adhesion |
| Reflectal R-5 | Peeled to Al. | Peeling |
| Ford Casting Alloy 332 | Peeled to Al. | Peeling |
| Ford Casting Alloy 103 | Peeled to Al. | Peeling |
| 7046 | Looked excellent | Excellent |
| 7075/7072 Clad | Looked Excellent | Excellent |
| 4343/7072 Clad | Looked OK on 4343 and looked OK on 7072 | Peeled to Al. on 4343 check was excellent on 7072 |
| 7178 | Appeared excellent | Excellent |
| 7075 | Appeared good | Excellent |
| 7016 | Looked excellent | Excellent |
| 7029 | Looked excellent | Excellent |

TABLE II

| Nominal Chemical Analysis - % by weight, other than Al | | | | | | | | | |
|---|---|---|---|---|---|---|---|---|---|
| Al. Alloy | Si | Cu | Mn | Mg | Cr | Ni | Zn | Ti | Zr |
| 2024 | — | 4.4 | — | 1.5 | — | — | — | — | — |
| 2036 | — | 2.6 | .25 | .45 | — | — | — | — | — |

TABLE II-continued

| Nominal Chemical Analysis - % by weight, other than Al | | | | | | | | | |
|---|---|---|---|---|---|---|---|---|---|
| Al. Alloy | Si | Cu | Mn | Mg | Cr | Ni | Zn | Ti | Zr |
| 3003 | — | .1 | 1.2 | — | — | — | — | — | — |
| 3105 | — | — | .6 | .5 | — | — | — | — | — |
| 4343 | 7.5 | — | — | — | — | — | — | — | — |
| 5457 | — | — | .3 | 1.0 | — | — | — | — | — |
| 5557 | .1 | .15 | .25 | .6 | — | — | — | — | — |
| 6061 | .6 | .3 | .15 | 1.0 | — | — | .25 | — | — |
| Reflectal R-5 Casting Alloy | — | — | — | .5 | — | — | — | — | — |
| Ford 332 Alloy | 9.5 | 3.0 | .5 | 1.0 | — | — | — | — | — |
| Ford 103 Alloy | 9.5 | 3.0 | .5 | 1.0 | — | — | — | — | — |
| 7046 | .1 max | 1.0 | — | 1.1 | — | — | 4.5 | .06 max | .1 |
| 7075 | — | 1.6 | — | 2.5 | .26 | — | 5.6 | — | — |
| 7072 | — | — | — | — | — | — | 1.0 | — | — |
| 7178 | .5 | 2.0 | .3 | 2.7 | .3 | — | 6.8 | .2 | — |
| 7016 | .1 max | 1.0 | — | 1.1 | — | — | 4.5 | .03 | — |
| 7029 | .1 max | .7 | — | 1.6 | — | — | 4.7 | .03 max | — |

LATERAL CORROSION

FIG. 1 graphically summarizes pertinent coating systems for aluminum that have been used by the prior art; in comparison, two inventive modes are also illustrated. Three of the prior art systems (Z-1, A-1 and Al-2) use immersion or chemical conversion coatings to obtain adherency to aluminum. Z-1 is a commercial zincate process which is referred to in some detail below; A-1 is a proprietary system employing a stannous bath that creates difficult process control. The Al-2 system is sometimes known as the Alcoa 661 process and presents difficult problems of dissolution of the zinc coating in the nickel treating bath. The ON-1 or anodic oxide process does not give good tight adherency of the coating system. The Du-1 (DuPont) process uses an electroplated white brass layer that contains about 90% zinc; such brass layer encourages significant lateral corrosion since elemental zinc is quite sacrificial.

In FIG. 2, pertinent prior art plating pretreatments for use on steel is summarized. There is little problem to obtaining good adhesion on steel and direct DC plating from cyanide solutions is commercial. Copper or nickel have been used as the interface layer with steel, but copper and nickel do not adhere to plate on aluminum. Thus the plating technology used on steel is not transplantable for use on aluminum. The brass intermediate layer in prior art system P-1, even if containing 60–75% copper, would not have the same corrosion protection that exists when the brass is directly coupled to the steel.

It should be noted that aluminum, by itself, is quite corrosion resistant because of the protection resulting from its natural oxide film. After being plated, aluminum no longer enjoys this natural protection. Plated aluminum is part of a potential galvanic couple. Aluminum will be the anode in most galvanic couples and will tend to dissolve (except with zinc from where aluminum is cathodic). Since aluminum is more reactive than steel, the dissoling rate can actually be faster than with steel.

The other metal or metals, will be less reactive and will tend to plate hydrogen gas; this is the electrolyte solution which most likely consists of water with ordinary road salt and sulfuric acid as the conductive materials. The relative speed of corrosion is in part related to the voltage of the galvanic couple. The voltage in turn depends on the reactivity of the metals involved.

One prior art process that illustrates the galvanic corrosion problem is that of the zincate process, wherein after suitable cleansing of the aluminum substrate, an immersion layer of zinc is applied typically in the thickness range of 0.000001 - 0.000005" (See FIG. 1). After a rinse, copper strike is electro-deposited thereover followed by the decorative coating of nickel and chromium, the nickel being usually about 0.001". The zinc is the most troublesome and vulnerable layer. Zinc is readily attacked and dissolved in the acid processing steps where nickel or acid copper plates are applied; accordingly some barrier deposit (such as thick copper) is necessary which adds cost.

The zinc anode is electrically connected to a very efficient large area cathode made of copper. As soon as the corrosive solution reaches the zinc layer through slight cracking (See FIG. 3) the latter will dissolve preferentially. This occurs very readily with just a slight scratch or pit in the plated coating. The corrosion rate will increase gradually. The area of the zinc anode will be merely the thin edge of zinc layer. The copper cathode is much larger. As the zinc dissolves away from the pit, it will produce undercutting and thereby the anode area exposed will increase as the circumference of a circle increases. There will be an accelerating effect. The anode cathode area ratio is steadily declining which means that the corrosion rate progressively rises. Once the zinc is substantially diminished or taken from the area, corrosion does not stop. The copper-aluminum couple is noted for corroding aluminum. Substantial dissolving of the aluminum occurs as long as the fresh electrolyte is available. The depletion of the electrolyte is about the only retarding factor in this galvanic couple. If the plate is ductile and does not rupture from the build up of the corrosion products, there may possibly be an eventual slow down of the corrosion. But usually the corrosion products proceed to such a catastrophic dimension that peeling and blistering of the plated system occurs. As a result, there will be wide spread lifting of the plated material (see FIG. 4), unsightly voluminous corrosion products beneath the plate and exuding of corrosion products from the ruptures, and the eventual weakening of the aluminum base.

Turning now to FIGS. 5 and 6, there is illustrated another prior art plating system which has been applied to aluminum, although it has achieved some success with respect to plating steel. This is a system relying upon a thin immersion layer of tin and a layer of bronze (0.00001") which in turn is followed by a nickel chromium plating. When corrosion does occur through a slight crack, scratch or pit, the corrosion will proceed vertically (that is perpendicular to the aluminum surface) and when it reaches the aluminum through a break in such coating, a galvanic couple immediately is operative between the aluminum and bronze. The area of the cathode initially is confined to the periphery of the pit. This is true especially of chromium as the top layer. Corrosion can continue almost indefinitely. However, the anode/cathode area ratio is larger. Also the potential gradient in the galvanic battery is smaller because aluminum and bronze are quite close together in the reactivity scale, and thus the corrosion rate is somewhat lower. However, corrosion will proceed by dissolving of the aluminum which will produce an undercut area beneath the bronze. The rate of attack around the periphery of the pit measured in depth of metal consumed for unit time will tend to decline. The cathode at the offset will consist mostly of the nickel with but a sliver of bronze exposed edgewise. As the corrosion progresses, ans undercutting develops successfully, more and more bronze plated nickel is exposed, the cathode gradually should become more efficient and the corrosion should increase. This system of course allows for the substrate to be directly attacked and left somewhat unprotected.

In the case of an anodized process for plating aluminum, nickel will remain the cathode, irrespective of how far the corrosion has progressed. The corrosion rate will be somewhat reduced. However, the underside of the nickel is attached to the bottom of the aluminum through the pores of the oxide. The disadvantage of the process is that the plating adhesion is poor. Corrosion products build up and pry the plate loose and when this happens, more cathode is exposed and corrosion speeds up.

From the above prior art, it can be appreciated that desirable or tolerable corrosion is that which (a) proceeds vertically through a plated system confining itself to a small pit, (b) never proceeds laterally through a layer of the system most adjacent to the aluminum substrate, and (c) reduces any eventual galvanic couple with aluminum to a minimum for retarding decay of the supporting substrate. The zincate process fails because corrosion proceeds laterally along the layer most adjacent the aluminum; the tin-bronze pretreatment fails because it sets up too high a galvanic couple with the aluminum causing considerable eventual decay. The anodic oxide process fails because of a lack of tight adherency of the pretreatment with the aluminum. But more importantly the corrosion mechanism should be controlled by an economical convenient electroplated pretreatment, which is contrary to these three prior art modes.

This invention overcomes the above prior art deficiencies by (a) controlling the alloy content of the aluminum substrate to contain 4–6% zinc or a recrystallized aluminum substrate with 1–8% zinc including 1–4 magnesium, and (b) electroplating a thin brass strike directly onto the aluminum article, the strike containing 60–75% copper to eliminate lateral corrosion along the article interface and to promote tight adherency, and to accommodate acid processing steps such as the plating of nickel directly thereonto. The plated system, in its broadest sense, is shown in FIG. 1, labelled invention Mode A. The thickness of the electrodeposited layers should be about: brass 0.0001", nickel 0.001", and chromium 0.000005". The reason for the high resistance of this system to lateral corrosion of the brass is not fully understood. Nonetheless, it is believed that the atomic bond between the aluminum and brass is such that vertical corrosion is mandated; there may be a zinc rich intermetallic region in the substrate between the brass and aluminum which promotes this bond and of course would change the galvanic couples of the elements of the system. The aluminum is attacked at a very low rate, and appearance is not effected because the small pits release white corrosion products and avoid peeling or blistering.

An alternative inventive plated system is shown in FIG. 1, (as Mode B) and FIGS. 7–8. A copper or nickel and copper layer 10 (0.00005") is enveloped between two brass layers 11–12, the first (11) having 60–75% copper to eliminate lateral corrosion at the interface with the aluminum substrate, but the other (12) having 45–60% Cu as-deposited to permit a slow, controlled sacrificial corrosion to protect the aluminum longer.

The copper 10 is pure copper and the brass layers are electrodeposited from brass cyanide solutions. The electromotive differential potential between nickel and the brass layer 12 is relatively small and the polarizing characteristic of brass (12) will be such that it does not substantially shift the small voltage potential and permits current to flow readily. Accordingly, brass (12) corrosion will undercut the nickel. This will take considerably longer than that experienced by any of the prior art methods and during this period of time, both the copper and brass (11) will be protecting the aluminum. If and when the brass (12) has been corroded so substantially penetration will occur through the copper or copper and nickel layer (10). If the corrosion should proceed through second brass layer 11, the galvanic couple between the high copper brass (11) and aluminum will be relatively small encouraging corrosion to proceed at a slower rate, if at all. The layer 11 will experience at most very slight sacrificial corrosion (lateral corrosion) to the Cu above; this is important to controlling corrosion to that which is vertical and least objectionable to appearance. Corrosion will proceed through the copper and brass in a substantially vertical direction, limiting the products of corrosion, and preventing pealing or breaking away of the plated layers due to blistering and lack of adherency.

a preferred detailed process Mode B would be as follows:

1. Select and employ a recrystallized aluminum substrate which is of the 7000 series containing 4–6% zinc.

2. Soak the aluminum alloy to provide a rough general surface cleaning. This soaking treatment may be carried out in three phases, (a) soaking in a mildly alkaline cleaning solution as in step (c) for the test examples page 11, for a period of time of 1–4 minutes at a temperature of 140°–180° F, (b) power spraying the aluminum substrate with a similar mildly alkaline cleaning solution as in (a), for a period of time of 1–3 minutes at a temperature of 110°–130° F, the power spray being carried out to direct the solution against the aluminum substrate with a force of about 16 psig, and (c) rinsing the soaked and sprayed substrate with water for a period of 1 minute at room temperature.

3. Subject the soaked aluminum substrate to a mild etching cleaner for producing an even etching of the aluminum surface. The etching solution is an alkaline, mildly or nonsilicated, electrocleaner or similarly formulated alkaline solution that provides an even etch on the surface when the aluminum is subjected for a period of time of 1–3 minutes; the solution being maintained at a temperature of about 100°–150° F. A preferential solution preparation may comprise: adding a powder in the proportion of 6–11 oz./gal. of water, the powder additive containing a maximum of 3–5% moisture, the powder including 68% sodium hydroxide, 0.5% minimum trisodium phosphate, 15% sodium metaphosphate, and 10% maximum sodium carbonate. The aluminum is then subjected to a water rinse to remove the products of the mildly etching alkaline solution, the water rinse being carried out for about 2 minutes at room temperature.

4. De-smut the etched and soaked aluminum alloy by immersion or dipping in a mild acid solution for a period of about 1 minute, the solution being maintained in the range of 60°–80° F. A preferential de-smutting solution may contain 2–12% by volume of sulfuric acid with added fluoride salts, such as 0.25 oz./gal. ammonium bi-flouride, and/or hydrogen peroxide. Rinse away the products of such de-smutting treatment by immersion in water for a period of 1 minute at room temperature.

5. Electrodeposit a brass strike onto the prepared aluminum substrate; immerse the article in the electrolyte with the full plating voltage on, the average plating current density being about 30–50 amps./sq./ft. Electrodeposit for 3–10 minutes with the electrolyte at a temperature of 70°–90° F, to obtain a strike about 0.0001". It is important that the brass strike deposit contain a high-copper content specifically in the range of 60–75% copper and the remainder zinc. To this end, the electrolyte must be comprised of:

(a) sodium cyanide 4.6–7.5 oz./gal.

(b) sodium hydroxide 2–4.0 oz./gal.

(c) sodium carbonate 4–12 oz./gal.

(d) total metal in solution including both copper and zinc being 3–6 oz./gal.; the copper, as a percent of the total, being 68–85% in solution and zinc, percent of total, being 32–15%. This may be achieved by employing zinc cyanide at about 5.0 oz./gal. and copper cyanide at about 5.0 oz./gal. There is no need to include a brightener in the brass plating electrolyte such as dimethylsulfamate or sodium polysulfide. Rinse the electroplated substrate in water at room temperature for about 1 minute.

6. Electrodeposit a copper or copper and nickel layer about 0.0005". The copper layer may be deposited progressively in layers such as first (a) employing a copper strike of 0.00005" utilizing an electrolyte having a general composition of 5.3 oz./gal. CuCN 6.7 oz./gal. NaCN, 4 oz./gal. $Na_2CO_3$ and 8 oz./gal. $KN_aC_4H_4O_6.4H_2O$; (b) plating an acid copper layer from a copper sulfphate and sulfuric acid electrolyte, the thickness being about 0.0004", and (c) plating a cyanide copper strike to a thickness of about 0.00005" (rinsing being provided after each of the copper layers).

7. Electrodeposit a high copper brass layer, thickness about 0.0003", containing copper in the range of 50–60%. The coated substrate from the previous steps is placed in the electrolyte without the current on, the current density being about 30–60 amps./sq./ft. and plating is carried out for a period of time of about 30 minutes to provide said thickness. The electrolyte preferably contains sodium hydroxide of 3.5 oz./gal., free sodium cyanide 6.5 oz./gal., copper cyanide 4 oz./gal., zinc cyanide 2.5 oz./gal. The substrate from this step is also rinsed with water at room temperature for about 1 minute.

8. Electrodeposit a copper layer thickness of about 0.00005" from a cyanide copper strike to insure optimum adhesion between the 50–60% copper brass layer and the following nickel layer. Rinse in water.

9. The substrate from the previous steps is then dipped in an acid containing 1% $H_2SO4$ (by vol) for a period of time of about 1 minute.

10. The previously plated substrate is then provided with an electrodeposit nickel plating to a thickness minimum of 0.0003", the nickel being bright and the nickel electrolyte being preferably comprised of 40 oz./gal. $NiSO_4$ 0.6H20, 18 oz./gal. $NiCl_2$ $6H_2O$, 6½ oz./gal. $H_3BO_3$ with brightening and wetting agents: the nickel plated substrate is then rinsed in water.

11. Finally the substrate is provided with outer chromium plating to a thickness of about 0.000005" in an electrolyte containing preferably 45 oz./gal. $CrO_3$ and 0.4 oz./gal. $H_22O_4$, and empolying a current density of about 175 A.S.F. The chromium plated substrate is then hot rinsed in water at about 190°–200° F and dried by blowing hot air thereover.

A series of test examples demonstrate the improved resistance to lateral corrosion of the inventive modes; the results of the tests are tabulated in Tables III and IV. The examples in Table III had the as-deposited copper varied in the first brass layer, but the substrate was consistently 7029 aluminum alloy. In Table IV, the substrate and mode was varied, along with % as-deposited copper. It is evident from these tables that to obtain no lateral corrosion after 64 hrs. of the CASS test, the substrate must contain 4–6% zinc, and the first brass layer must contain 60–75% Cu as deposited. It is further evident, as shown in FIG. 9, that only that sample containing 63% copper had a sharply defined scribe mark after 64 hrs. CASS test.

For these samples, the corrosion performance of plated aluminum alloy panels or sections were studied by use of the CASS test using the standard procedure specified in ASTM B-368. This test essentially comprises exposing the cleaned plated panels for increasing periods of time to a fog in a closed chamber. The fog is generated from a salt-copper solution adjusted to a required PH with glacial acetic acid. The test cycles were for 16 hours each and four such cycles were used. Prior to testing, each panel or section was scribed with an x-pattern; scribing was by a carbide cutting tool which cut through the plating into the base metal. The panels or sections were then sectioned through the scribe and photomicrographs taken of the corrosion progress, if any.

PHYSICAL CHARACTERISTICS OF THE AS-PLATED PRODUCT

FIGS. 10–17 are photomicrographs of the sectioned scribe marks in 7029 aluminum panels B-8, G-1, G-3 and G-7 of Table III. FIG. 16 (at 50X) shows that 26% Cu in the brass causes considerable lateral corrosion and delamination at 13, the tip of said lateral corrosion is enlarged in FIG. 17. In FIG. 14 (at 50X) the sample contained 42% Cu in the 1st brass layer and this permitted again considerable lateral corrosion, the magnification of the corrosion progression is shown in FIG. 15. In FIG. 12, the use of 56% Cu in the brass strike still allowed some lateral corrosion to proceed from the scribe along the brass. Only in FIGS. 10 and 11 (for 63% Cu) do we see a tight adherency between the brass strike 14 and aluminum 15 with no lateral corrosion.

TABLE III

CASS RESULTS

| Example | Brass Strike % | | 16 Hours | | | 32 Hours | | | 48 Hours | | | 64 Hours | | |
|---|---|---|---|---|---|---|---|---|---|---|---|---|---|---|
| | | | Corrosion | | Blister | Corrosion | | Blister | Corrosion | | Blister | Corrosion | | Blister |
| Bash | Copper Deposit | Copper Strike | At Scribe | At Edge | Diameter | At Scribe | At Edge | Diameter | At Scribe | At Edge | Diameter | At Scribe | At Edge | Diameter |
| 58 | 55.9 | No | 1MM | — | 2MM | 4MM | 1MM | — | 4MM | 3MM | — | 4MM | 4MM | 4–5MM |
| 53 | 52 | No | 2MM | — | — | 2MM | 1MM | — | 2MM | 1MM | — | 3MM | 2MM | — |
| 45 | 41.8 | Yes | None | None | None | 2MM | 2MM | — | 2MM | 3MM | — | 2MM | 5MM | — |

TABLE III-continued

| | | | CASS RESULTS | | | | | | | | | | | |
|---|---|---|---|---|---|---|---|---|---|---|---|---|---|---|
| | Brass Strike % | | 16 Hours | | | 32 Hours | | | 48 Hours | | | 64 Hours | | |
| | | | Corrosion | | Blister | Corrosion | | Blister | Corrosion | | Blister | Corrosion | | Blister |
| Example Bash | Copper Deposit | Copper Strike | At Scribe | At Edge | Diameter | At Scribe | At Edge | Diameter | At Scribe | At Edge | Diameter | At Scribe | At Edge | Diameter |
| 29.5 | 32.0 | Yes | <1MM | — | 10 blister each 1MM | 1MM | 1MM | — | 3MM | 2MM | — | 3MM | 5MM | large blisters and 3 small blisters <1MM -4MM |
| 20.3 | 26.0 | Yes | None | None | Many small blisters <1MM | 2MM | 2MM | — | 3MM | 4MM | — | 4MM | 5MM | Many <1MM -4MM |
| 75 | 63.0 | Yes | None | None | None | None | None | None | None | None | None | None | None | None |
| 75 | 63.0 | No | None | None | None | None | None | None | None | None | None | 1MM | None | None |

TABLE IV

| | | | % Cu in Electroplated Brass Strike (1st Layer) | CASS Results (visual inspection from top | | | |
|---|---|---|---|---|---|---|---|
| 7016 | Alstan tin immersion | 52% Brass, Ni and Cr | | OK | OK | OK | 1/32" |
| 7016 | " | " | | 1/16" | 1/8" | 1/4" | 1/4" |
| 7016 | " | " | | OK | OK | OK | OK |
| 7029 | " | " | | | | | |
| 7046 | Electroplated Brass Strike & Cyanide Cu Strike & Acid Cu | " | | 1/16" | 1/8" | 1/8" | 3/8" |
| 7029 | " | " | 65 | OK | OK | OK | OK |
| 7029 | " | " | 58.3 | OK | OK | OK | <1/32" |
| 7029 | " | " | 56.3 | OK | OK | <1/32 | <1/32 |
| 7029 | " | " | 58.7 | OK | OK | OK | <1/32 |
| 7029 | " | " | 56.3 | OK | OK | <1/32 | 1/32 |
| 7029 | " | " | 65.8 | OK | OK | OK | OK |
| 7029 | " | " | 65 | OK | OK | OK | OK |
| 7029 | " | " | 58.7 | OK | OK | OK | <1/32 |
| 7046 | " | " | 51 | <1/32" | 1/32 | 1/16 | 1/16" |
| 7046 | " | " | 58.3 | 1/32 | 1/32 | 1/32 | 1.16 |
| 7046 | " | " | 58.0 | 1/32 | 1/16 | 1/8 | 3/16 |
| 7046 | " | " | 58.0 | 1/32 | 1/16 | 3/32 | 1/8 |

Based upon the foregoing description of the invention, we claim:

1. A method of treating an aluminum article prior to plating, said aluminum article having high adherence of plating thereover, comprising:

(a) selecting said aluminum article to contain 1–8% zinc in the alloyed condition, (b) cleaning said aluminum article to be substantially free of aluminum oxide, (c) immediately thereafter immersing said cleansed article in an aqueous solution prepared by adding 6–11 oz. of a powder additive per gallon of water, said additive consisting of: 68% sodium hydroxide, 0.5% minimum trisodium phosphate, 15% sodium metaphosphate, and 10% maximum sodium carbonate, (d) rinsing for 1–5 minutes at 100°–150° F.

2. The method as in claim 1, in which step (b) comprises (i) soaking the aluminum article in a mildly alkaline cleaner solution at 140°–180° F for 1–4 minutes, (ii) washing the soaked article with a mildly alkaline water solution at 110°–130° F by use of a power spray for 1–3 minutes, (iii) rinsing said article with water at room temperature, and in which step (c) is followed by a de-smut operation wherein the article is exposed to a mild acid etching solution at room temperature for 1–3 minutes, the mild acid etching solution containing 2–12% by volume of sulphuric acid with 0.25 oz./gal. ammonia biflouride.

* * * * *